US008704730B2

(12) United States Patent
Lopez et al.

(10) Patent No.: US 8,704,730 B2
(45) Date of Patent: Apr. 22, 2014

(54) METAMATERIAL ANTENNA DEVICE WITH MECHANICAL CONNECTION

(75) Inventors: Norberto Lopez, San Diego, CA (US); Ajay Gummalla, Sunnyvale, CA (US)

(73) Assignee: Tyco Electronics Services GmbH (CH)

( * ) Notice: Subject to any disclaimer, the term of this patent is extended or adjusted under 35 U.S.C. 154(b) by 330 days.

(21) Appl. No.: 13/083,081

(22) Filed: Apr. 8, 2011

(65) Prior Publication Data

US 2011/0273348 A1 Nov. 10, 2011

Related U.S. Application Data

(63) Continuation-in-part of application No. 12/604,306, filed on Oct. 22, 2009.

(60) Provisional application No. 61/322,260, filed on Apr. 8, 2010.

(51) Int. Cl.
*H01Q 15/02* (2006.01)

(52) U.S. Cl.
USPC ..... 343/909; 343/700 MS; 343/853

(58) Field of Classification Search
USPC ..... 343/909, 700 MS, 853, 876
See application file for complete search history.

(56) References Cited

U.S. PATENT DOCUMENTS

| | | | | |
|---|---|---|---|---|
| 7,592,957 | B2 | 9/2009 | Achour et al. | |
| 2003/0063032 | A1 | 4/2003 | Usui et al. | |
| 2005/0151698 | A1* | 7/2005 | Mohamadi | 343/795 |
| 2007/0176827 | A1 | 8/2007 | Itoh et al. | |
| 2008/0258981 | A1 | 10/2008 | Achour et al. | |
| 2008/0303743 | A1 | 12/2008 | Park et al. | |
| 2009/0128446 | A1 | 5/2009 | Gummalla et al. | |
| 2009/0135087 | A1 | 5/2009 | Gummalla et al. | |
| 2009/0295660 | A1 | 12/2009 | Xu et al. | |
| 2010/0013714 | A1* | 1/2010 | Azhari | 343/700 MS |
| 2010/0225554 | A1* | 9/2010 | Huang et al. | 343/821 |
| 2011/0095964 | A1 | 4/2011 | Pathak et al. | |

FOREIGN PATENT DOCUMENTS

| | | | |
|---|---|---|---|
| CN | 1624977 | A | 6/2005 |
| CN | 1945898 | A | 4/2007 |
| CN | 202159758 | U | 3/2012 |
| JP | 10084216 | | 3/1998 |
| JP | 2005244452 | | 9/2005 |
| KR | 20080017857 | A1 | 2/2008 |
| WO | WO-2006051257 | A1 | 5/2006 |
| WO | WO-2009049303 | A1 | 4/2009 |
| WO | WO-2011049584 | A1 | 4/2011 |

OTHER PUBLICATIONS

U.S. Appl. No. 12/604,306 , Response filed Oct. 1, 2012 to Non Final Office Action mailed Apr. 30, 2012, 11 pgs.
U.S. Appl. No. 12/604,306, Final Office Action mailed Nov. 21, 2012, 12 pgs.
U.S. Appl. No. 12/604,306, Non Final Office Action mailed Apr. 30, 2012, 11 pgs.

(Continued)

*Primary Examiner* — Ahshik Kim

(57) ABSTRACT

A wireless device incorporating an antenna made of Composite Right Left Hand (CRLH) structures, having a connection element coupling a portion of the antenna to a ground electrode. In some embodiments a wireless device has one or more mechanical connection units made of electrically conductive materials to provide both mechanical engagement and electrical conduction for the antenna devices.

20 Claims, 9 Drawing Sheets

(56) References Cited

OTHER PUBLICATIONS

U.S. Appl. No. 12/604,306, Notice of Allowance mailed May 10, 2013, 16 pgs.
U.S. Appl. No. 12/604,306, Notice of Allowance mailed Jul. 19, 2013, 6 pgs.
U.S. Appl. No. 12/604,306, Response filed Apr. 22, 2013 to Final Office Action mailed Nov. 21, 2012, 12 pgs.
Chinese Application Serial No. 201010521852.7, Office Action mailed Mar. 5, 2013, 11 pgs.
Chinese Application Serial No. 2010205979435.3, Notification of the Second Amendment Response filed on Sep. 23, 2011, 2 pgs.
Chinese Application Serial No. 201020579435.3, Office Action mailed Jan. 26, 2011, 2 Pgs.
Chinese Application Serial No. 201020579435.3, Office Action mailed Jul. 8, 2011, 4 pgs.
Chinese Application Serial No. 201020579435.3, Office Action Response Filed Jun. 10, 2011, 43 pgs.
International Application Serial No. PCT/US2009/061945, International Search Report and Written Opinion mailed Nov. 26, 2010, 9 pgs.
International Application Serial No. PCT/US2009/061945/ International Preliminary Report on Patentability mailed May 3, 2012, 6 pgs.
Caloz, Christophe, et al., "Electromagnetic Metamaterials: Transmission Line Theory and Microwave Applications", John Wiley & Sons, (2006), 186 pgs.
Itoh, T., "Invited Paper: Prospects for Metamaterials", Electronics Letters, 40(16), (Aug. 2004), 972-973.

* cited by examiner

300

METAMATERIAL ANTENNA DEVICE WITH MECHANICAL CONNECTION

PRIORITY CLAIMS AND RELATED APPLICATIONS

This application claims the benefit of priority under 35 U.S.C. 119(e) to U.S. patent application Ser. No. 61/322,260 entitled "METAMATERIAL ANTENNA DEVICE WITH MECHANICAL CONNECTION," filed on Apr. 8, 2010, which is incorporated herein by reference in its entirety.

This application is also a continuation-in-part of U.S. patent application Ser. No. 12/604,306, entitled "METAMATERIAL ANTENNA WITH MECHANICAL CONNECTION," filed on Oct. 22, 2009, which is incorporated herein by reference in its entirety.

BACKGROUND

Communication devices having wireless capabilities are often designed to have a variety of functional units and components. Cellular phones are designed to be used in a variety of communication systems, including support of multiple air protocols and standards. The various functions may be incorporated or enhanced by physical structures, including conductive structures.

DETAILED DESCRIPTION

Figure 1B:
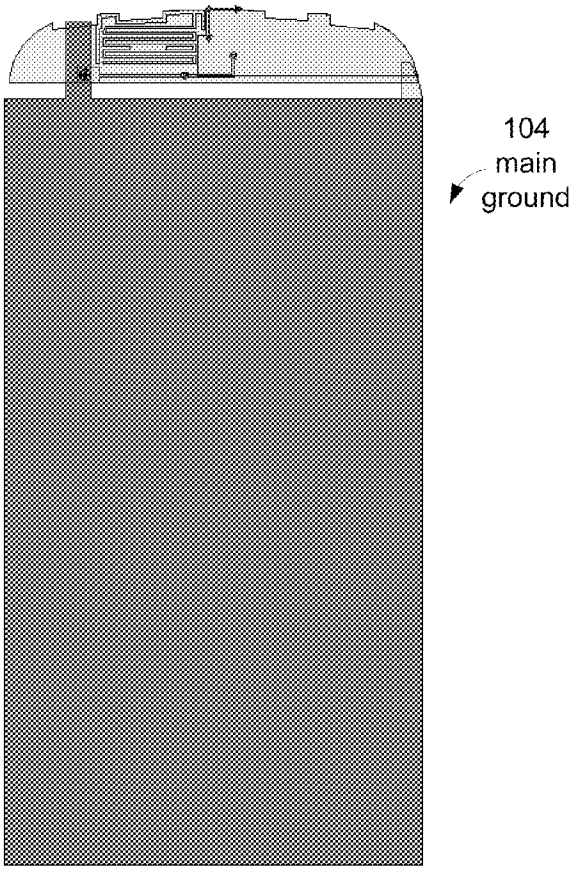
FIGS. 1A and 1B illustrate top views of a printed circuit hoard (PCB) configuration inside a cell phone.

A metamaterial may be defined as an artificial structure which behaves differently from a natural Right Handed (RH) material alone, Unlike RH materials, a metamaterial may exhibit a negative refractive index, wherein the phase velocity direction is opposite to the direction of the signal energy propagation where the relative directions of the (E,H,β) vector fields follow a left-hand rule. When a metamaterial is designed to have a structural average unit cell size ρ which is much smaller than the wavelength of the electromagnetic energy guided by the metamaterial, the metamaterial behaves like a homogeneous medium to the guided electromagnetic energy. Metamaterials that support only a negative index of refraction with permittivity ∈ and permeability μ being simultaneously negative are pure Left Handed (LH) metamaterials.

A metamaterial (MTM) structure may be a combination or mixture of an LH metamaterial and an RH material; these combinations are referred to as Composite Right and Left Handed (CRLH) materials, CRLH structures may be engineered to exhibit electromagnetic properties tailored to specific applications. Additionally, CRLH materials may be used in applications where other materials may be impractical, infeasible, or unavailable to satisfy the requirements of the application. In addition, CRLH materials may be used to develop new applications and to construct new devices that may not be possible with RH materials and configurations.

To better understand MTM and CRLH structures, first consider that the propagation of electromagnetic waves in most materials obeys the right-hand rule for the (E,H,β) vector fields, which denotes the electrical field E, the magnetic field H, and the wave vector β (or propagation constant). In these materials, the phase velocity direction is the same as the direction of the signal energy propagation (group velocity) and the refractive index is a positive number. Such materials are referred to as Right/Handed (RH) materials. Most natural materials are RH materials, but artificial materials may also be RH materials.

A CRLH MTM design may be used in a variety of applications, including wireless and telecommunication applications. The use of a CRLH MTM design for elements within a wireless application often reduces the physical size of those elements and improves the performance of these elements. In some embodiments, CRLH MTM structures are used for antenna structures and other RF components. A CRLH metamaterial behaves like an LH metamaterial under certain conditions, such as for operation at low frequencies; the same CRLH metamaterial may behave like an RH material under other conditions, such as operation at high frequencies.

Implementations and properties of various CRLH MTMs are described in, for example, Caloz and Itoh, "Electromagnetic Metamaterials: Transmission Line Theory and Microwave Applications," John Wiley & Sons (2006), CRLH MTMs and their applications in antennas are described by Tatsuo Itoh in "Invited paper: Prospects for Metamaterials," Electronics Letters, Vol. 40, No, 16 (August, 2004).

Metamaterials are manmade composite materials and structures engineered to produce desired electromagnetic propagation behavior not found in natural media. The term "metamaterial" refers to many variations of these mart-made structures, including Transmission-Lines (IL) based on electromagnetic CRLH propagation behavior. Such structures may be referred to as "metamaterial-inspired" as these structures are formed to have behaviors consistent with those of a metamaterial.

Metamaterial technology, as used herein, includes technical means, methods, devices, inventions and engineering works which allow compact devices composed of conductive and dielectric parts and are used to receive and transmit electromagnetic waves, Using MTM technology, antennas and RF components may be made very compactly in comparison to competing methods and may be very closely spaced to each other or to other nearby components while at the same time minimizing undesirable interference and electromagnetic coupling. Such antennas and RF components further exhibit useful and unique electromagnetic behavior that results from one or more of a variety of structures to design, integrate, and optimize antennas and RF components inside wireless communications devices CRLH structures are structures that behave as structures exhibiting simultaneous negative permittivity (∈) and negative permeability (μ) in a frequency range and simultaneous positive ∈ and positive μ in another frequency range. Transmission-Line (TL) based CRLH structure are structures that enable TL propagation and behave as structures exhibiting simultaneous negative permittivity (∈) and negative permeability (μ) in a frequency range and simultaneous positive ∈ and positive μ in another frequency range. The CRLH based antennas and TLs may be designed and implemented with and without conventional RF design structures.

Antennas, RF components and other devices made of conventional conductive and dielectric parts may be referred to as "MTM antennas," "MTM components," and so forth, when they are designed to behave as an MTM structure. MTM components may be easily fabricated using conventional conductive and insulating materials and standard manufacturing technologies including hut not limited to: printing, etching, and subtracting conductive layers on substrates such as FR4, ceramics, LTCC, MMICC, flexible films, plastic or even paper.

In one example a metamaterial structure may be a periodic structure with N identical unit cells cascading together where each cell is much smaller than one wavelength at the operational frequency. The unit cell is then a single repeatable metamaterial structure. In this sense, the composition of one metamaterial unit cell is described by an equivalent lumped circuit model having a series inductor ($L_R$), a series capacitor ($C_L$), shunt inductor ($L_L$) and shunt capacitor ($C_R$) where $L_L$ and $C_L$ determine the LH mode propagation properties while $L_R$ and $C_R$ determine the RH mode propagation properties. In a dispersion curve, $\beta>0$ identifies the RH mode while $\beta<0$ identifies the LH mode. An MTM device exhibits a negative phase velocity depending on the operating frequency.

An MTM antenna device, for example, includes a cell patch, a feed line, and a via line. The cell patch is the radiating element of the antenna, which transmits and receives electromagnetic signals. The feed line is a structure that provides an input signal to the cell patch for transmission and receives a signal from the cell patch as received by the cell patch. The feed line is positioned to capacitively couple to the cell patch. The configuration of the feed line capacitively coupled to the cell patch introduces a capacitive coupling to the feed port of the cell patch. The device further includes a via tine coupled to the cell patch, and the via line is part of a truncated ground element. The via line is connected to a separate ground voltage electrode, and acts as an inductive load between the cell patch and the ground voltage electrode.

The electrical size of a conventional transmission line is related to its physical dimension; thus, reducing device size usually means increasing the operational frequency. Conversely, the dispersion curve of a metamaterial structure depends mainly on the values of the four CRLH parameters, $C_L$, $L_L$, and $C_R$. As a result, manipulating the dispersion relations of the CRLH parameters enables a small physical RE circuit having electrically large RF signals.

As used herein, the terms "metamaterial," "MTM," "CRLH," and "CRLH MTM" refer to composite LH and RH structures engineered using conventional dielectric and conductive materials to produce unique electromagnetic properties, wherein such a composite unit cell is much smaller than the wavelength of the propagating electromagnetic waves.

CRLH structures can be used to construct antennas, transmission tines and other RF components and devices, allowing for a wide range of technology advancements such as functionality enhancements, size reduction and performance improvements. Unlike conventional antennas, the MTM antenna resonances are affected by the presence of the Left-Handed (LH) mode. In general, the LH mode helps excite and better match the tow frequency resonances as well as improves the matching of high frequency resonances. These MTM antenna structures can be fabricated by using a conventional FR-4 Printed Circuit Board (PCB) or a Flexible Printed Circuit (FPC) board. Examples of other fabrication techniques include thin film fabrication technique, System On Chip (SOC) technique, Low Temperature Co-fired Ceramic (LTCC) technique, and Monolithic Microwave Integrated Circuit (MMIC) technique.

Some examples and implementations of MTM antenna structures are described in the U.S. patent applications: Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009.

A Single-Layer Metallization (SLM) MTM antenna structure utilizes one metallization layer on a substrate for constructing the antenna elements. A Two-Layer Metallization Via-Less (TLM-VL) MTM antenna structure is another type of MTM antenna structure having two metallization layers on two parallel surfaces of a substrate. A TLM-VL does not have conductive vias connecting conductive portions of one metallization layer to conductive portions of the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008. MTM antennas with multi-layer metallization with vias are described in the U.S. patent application Ser. No. 12/270,410 entitled "Metamaterial Structures with Multilayer Metallization and Via," filed on Nov. 13, 2008.

Mechanical designs in conjunction with MTM antennas may be devised and/or improved. Examples of using electrically conductive mechanical connections, such as screws and clips, for constructing an MTM antenna structure are described, for example, in the U.S. patent applications: Ser. No. 12/604,306, entitled "Metamaterial Antenna with Mechanical Connection," filed Oct. 22, 2009; and Ser. No. 12/465,571, entitled "Non-Planar Metamaterial Antenna Structures," filed on May 13, 2009. In some implementations, mechanical connection units are used to provide: (1) mechanical coupling, stability, anchoring or support and (2) desired electrical conductive path and connection for the antenna elements. Such a conductive mechanical connection unit can effectively increase the area and volume of the antenna, thereby improving the antenna efficiency without increasing the occupied space. In the present implementations described in this document, mechanical connection units are used to couple two separate grounds, instead of antenna elements as in the previous cases described in the above-mentioned patent applications, to provide mechanical stability as welt as a short-cut electrical connection between grounds. As a result, an extra space may become available for installing or adding other components or antenna elements, thereby improving overall device performance. Examples of mechanical connection units include fasteners such as screws, anchors, pins, nails, clips, spacers and standoffs, rods and studs, and inserts, which can be used in combination with screw bosses, nuts, washers, rings, etc.

Figure 1A:
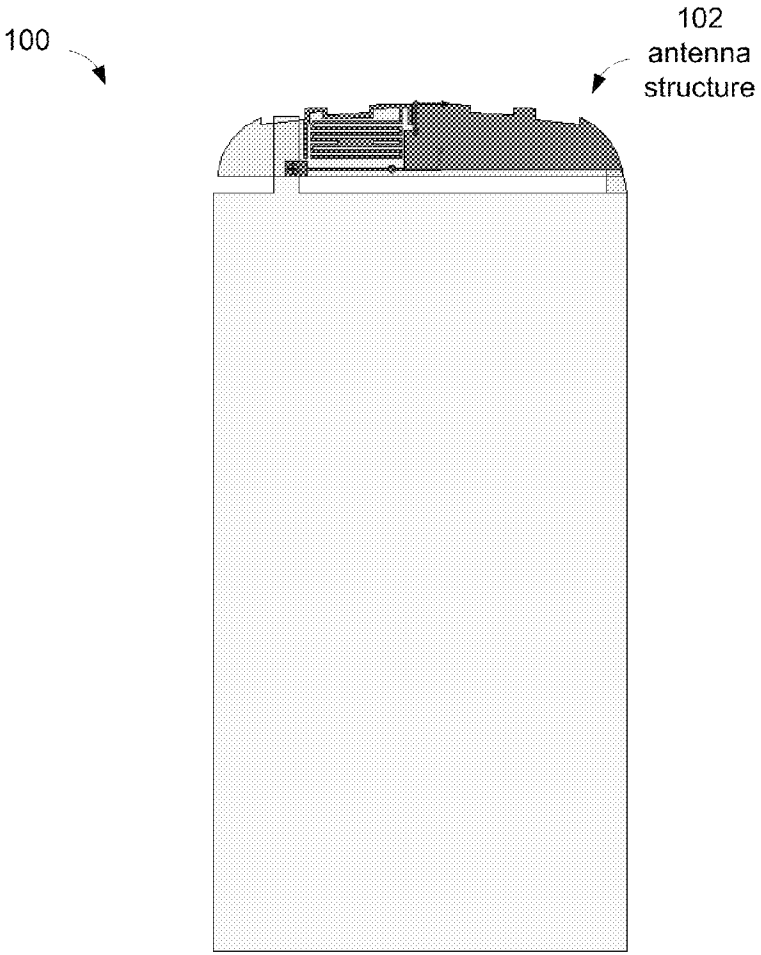

As an example, the implementations described in this document involve two boards in a cell phone. One board is an antenna PCB accommodating antenna elements and an antenna ground; and the other board includes a main ground for the cell phone. The antenna PCB may be based on a dielectric substrate such as an FR-4 with the antenna elements printed on the top and bottom surfaces of the substrate. Alternatively, the antenna may be printed on a flex film, for example. The main ground may be a simple metal board providing the ground electrode, or a conductive plane printed on a surface of another substrate. These two boards, i.e., the antenna. PCB and the main ground, are placed on top of each other in a cell phone. FIGS. 1A and 1B illustrates a top view of the board configuration inside of a cell phone 100, where the antenna elements 102 and an antenna ground 104 are illustrated on the substrate or Printed Circuit Board (PCB). FIG. 1B illustrates the same top view of the board configuration, where the main ground is indicated by shading. The antenna and the main ground are formed by using separate boards, and this example uses a screw to connect the antenna ground and the main ground. In this example, the screw is located away from the board edge.

Figure 2A:
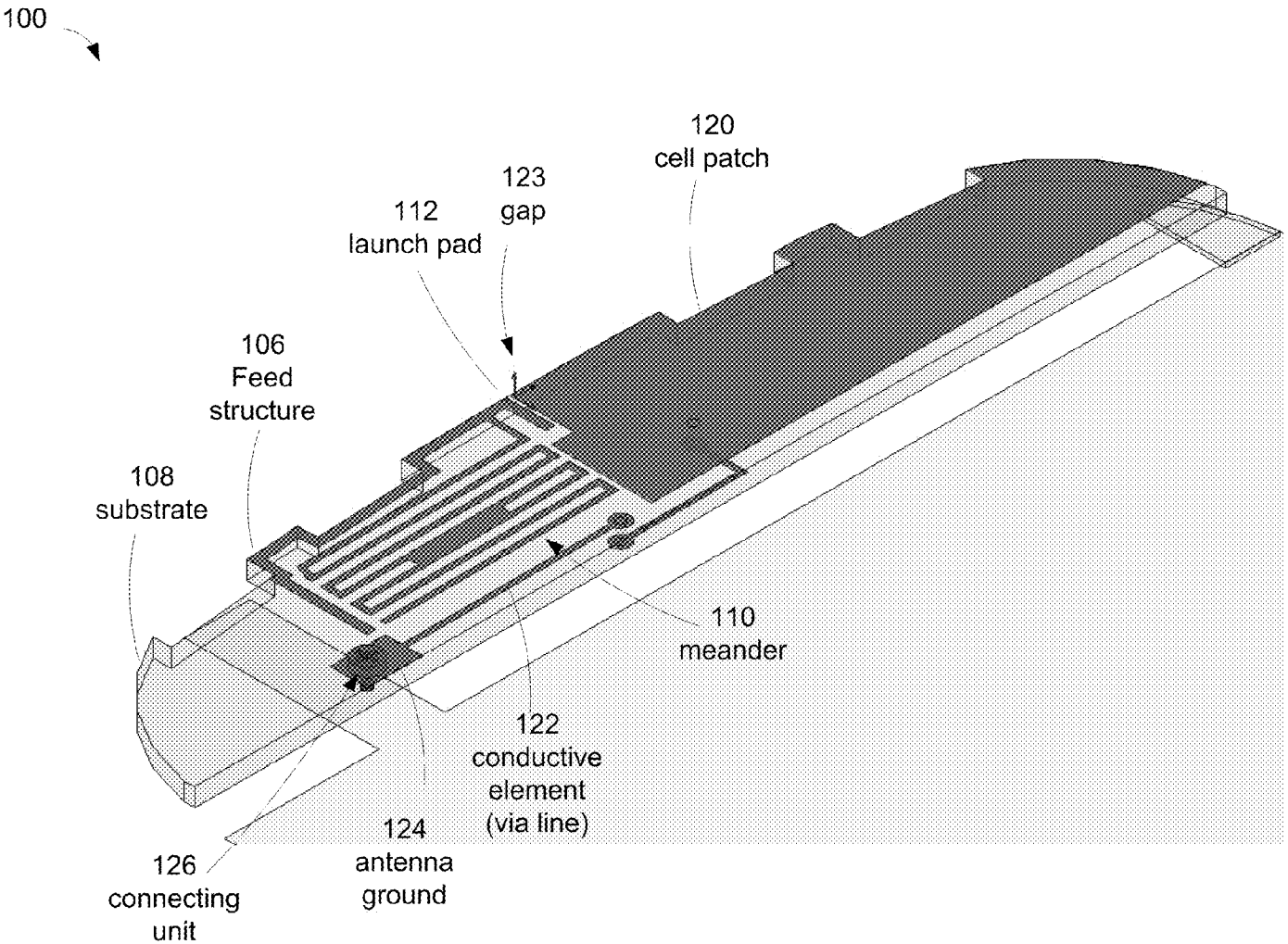
FIGS. 2A, 2B and 2C illustrate details of an antenna PCB.
Figure 2B:
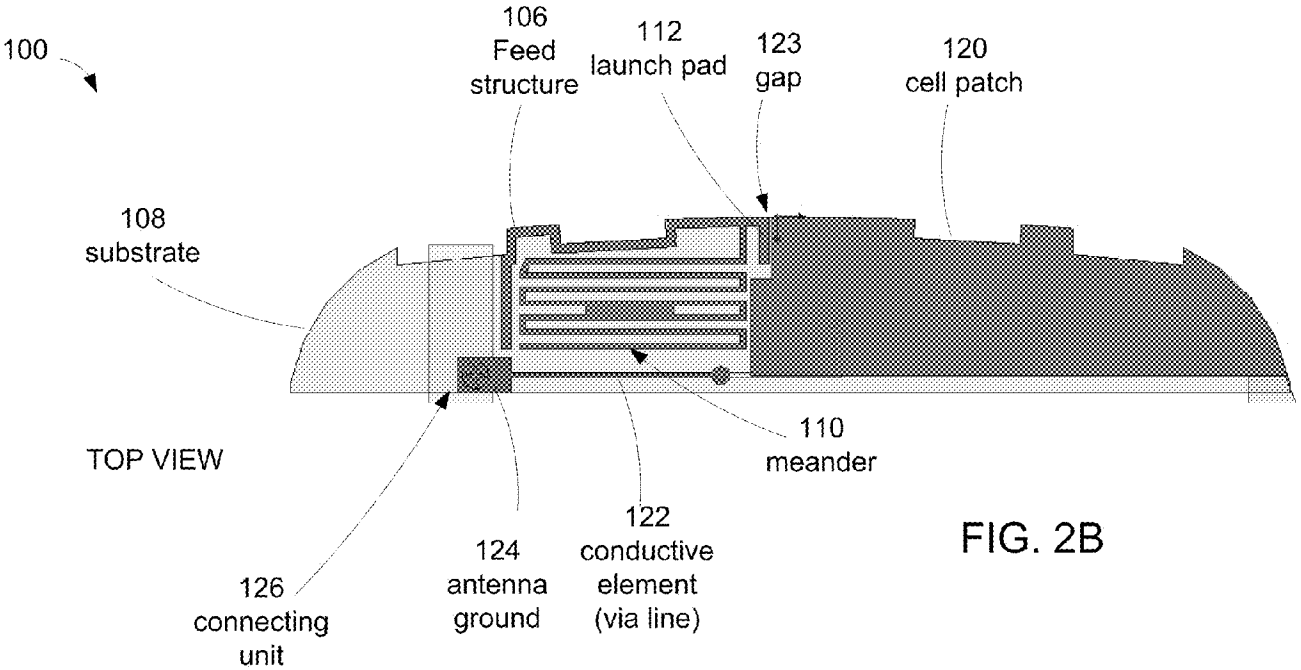
Figure 2C:
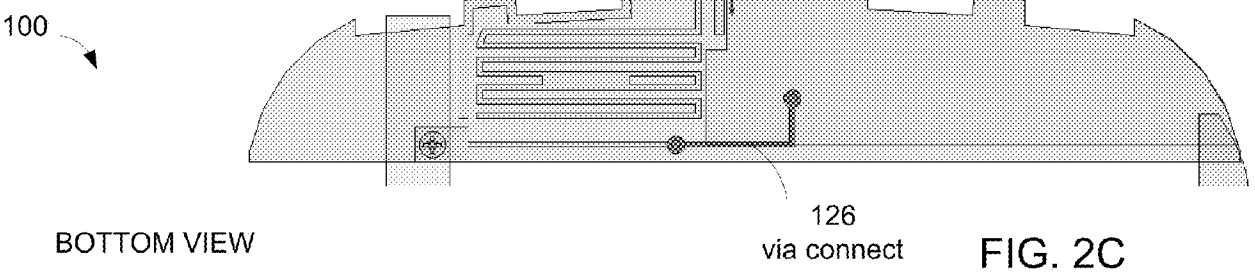

FIGS. 2A, 2B and 2C illustrate details of the antenna PCB. FIG. 2A shows the 3D view including the antenna designed based on a CRLH structure; FIG. 2B shows the top view with the antenna elements and the antenna ground on the top surface of the antenna PCB indicated by shading; and FIG. 2C shows the top view with the antenna element on the bottom surface of the antenna PCB indicated by shading. A cell patch 120 is capacitively coupled to feed structure 106 through gap 123. A capacitive element, such as a discrete capacitor, may also be used. The feed structure includes a meander portion 110 and a launch pad 112. The launch pad 112 forms the capacitive coupling with the cell patch 120. This capacitance is a Left Hand (LH) capacitance which is designed to induce the lower LH resonant frequencies. Therefore, the launch pad. 112 and the entire feed structure 108 is designed to achieve a $C_L$ which will result in the target frequencies. The antenna structure has an associated resonant frequency, which results from the RH components of the antenna structure, specifically, $C_R$ and $L_R$. Generally, the RH resonant frequencies are higher frequencies than the LH resonant frequencies.

These CRLH structures are formed as a metallic layer on a substrate 108. The cell patch is further coupled to a conductive element 122, which is coupled to an antenna ground 124. The antenna ground 124 is coupled to a connecting unit 126 which acts as part of the antenna ground electrode. FIG. 2C further illustrates a via connect 126 coupling the cell patch 120 and the conductive element 122.

As illustrated the antenna of device 100 has several antenna elements formed on the top and bottom surfaces of the antenna PCB. A feed line is formed on the top surface to receive or transmit antenna signals from an antenna port (not shown) coupled to the antenna ground. The antenna port may be located in the main ground, and a connector may be used to couple the feed line to the antenna port. The distal end of the feed line is capacitively coupled through a coupling gap to a cell patch also formed on the top surface, The shapes and dimensions of the feed line, the coupling gap and the cell patch are designed primarily to induce adequate LH series capacitance $C_L$ for the underlying application. A via 1 penetrates the antenna PCB to couple the cell patch on the top surface and a via line 1 on the bottom surface. A via 2 is also formed in the antenna PCB to coupled the via line 1 to a via line 2 formed on the top surface. The via line 2 is coupled to the antenna ground, which is coupled to the main ground via a screw. In this example, the main ground is shaped to provide an extended portion for the contact, The extended portion of the main ground is formed away from the board edge. The shapes and dimensions of these vias and via lines are designed primarily to induce adequate LH shunt inductance $L_L$ for the application. A meander tine is attached to the feed tine to induce a low-frequency monopole mode for broadening a low-frequency band including an LH mode. A conductive bridge is added to the meander line to couple two portions of the bending path of the meander line to shift unwanted high harmonic modes to a high frequency region, e.g., 2100 MHz and above, which is higher than the frequency range of interest for the application.

Figure 3:
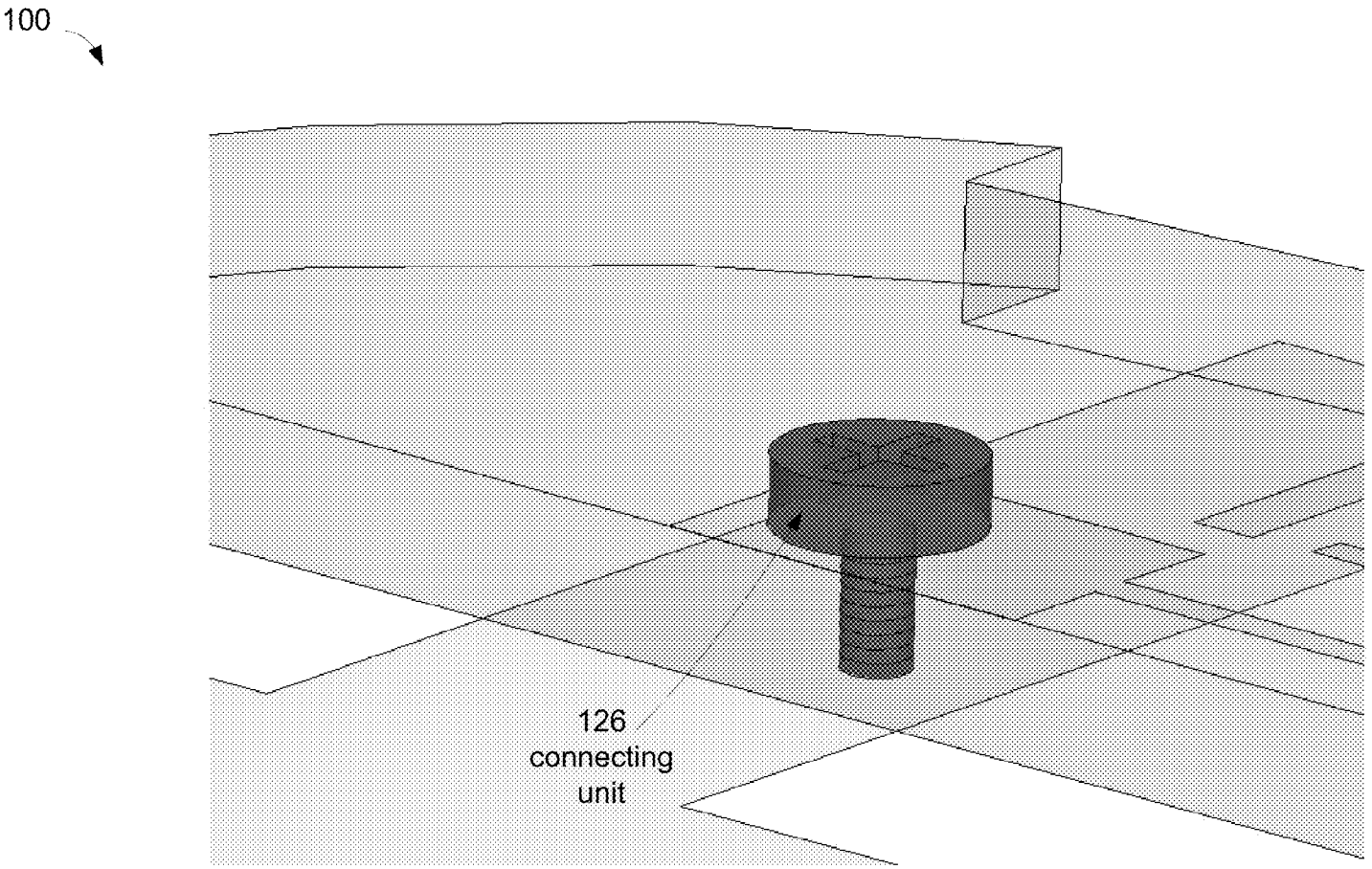
FIG. 3 illustrates details of a connecting unit between an antenna ground and a main ground.

FIG. 3 illustrates details as to how the connecting unit 122, which in this embodiment is a screw, is placed to connect the antenna ground and the main ground. This example shows a case in which the screw penetrates the antenna PCB vertically and mechanically fastens the antenna PCB to the main ground without a gap between the two boards, thus providing mechanical stability and support for the antenna PCB. At the same time, the screw provides a conductive path between the antenna ground and the main ground, thus providing a short cut connection instead of routing, for example. Use of a mechanical connection such as a screw eliminates the need for a bulky plastic holder with snaps that generally is used to provide mechanical stability for the antenna PCB inside of a cell phone. Use of solid mechanical connections such as screws, rods, pins, etc, provide a physical contact between two boards, whereas spring-based mechanical connections such as C-clips, pogo-pins, etc. provide a pressure contact. In general, simple screws have cost advantages over spring-based connections. Furthermore, screws are typically used at certain locations to fasten two boards in a cell phone; thus, simple modifications of the board designs may allow for shifting the positions of existing screws to the positions that have electrical advantages.

Figure 4B:
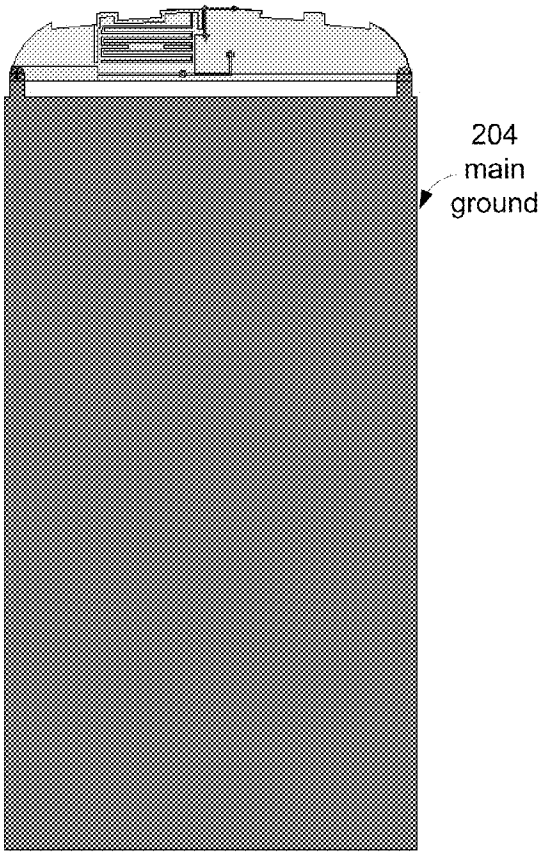
FIGS. 4A and 4B illustrate another example of a connecting unit.
Figure 4A:
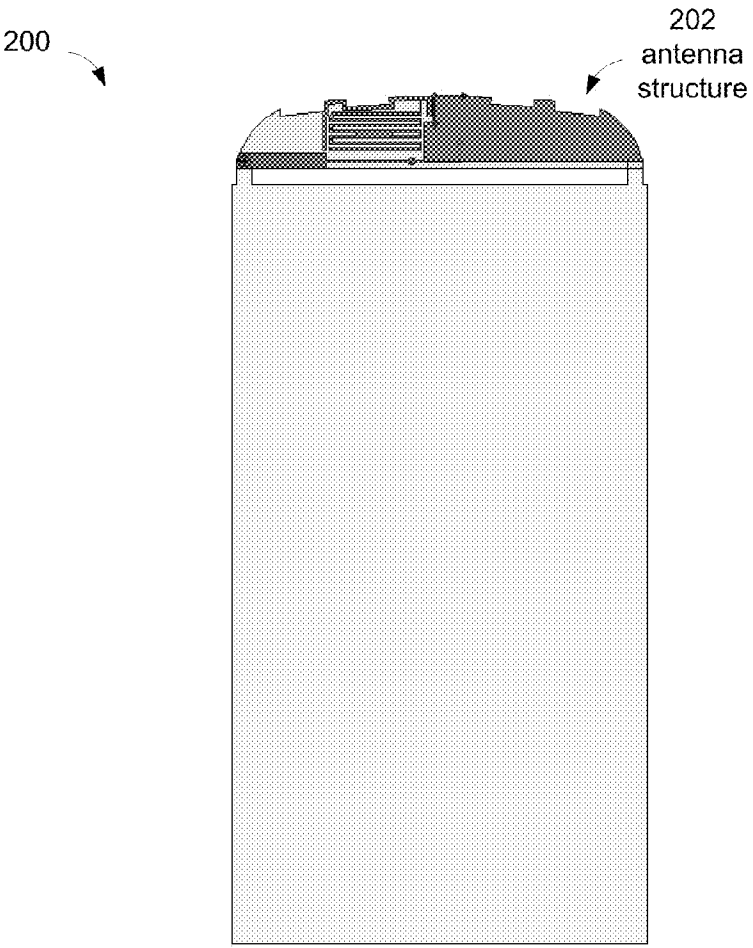

FIGS. 4A and 4B illustrates another implementation example of a connecting unit with an antenna in a device 200. The antenna elements 202 are formed with a similar design as in the previous antenna example of device 100 and are similarly based on a CRLH structure. The main ground 204 is illustrated in FIG. 4B.

Figure 5:
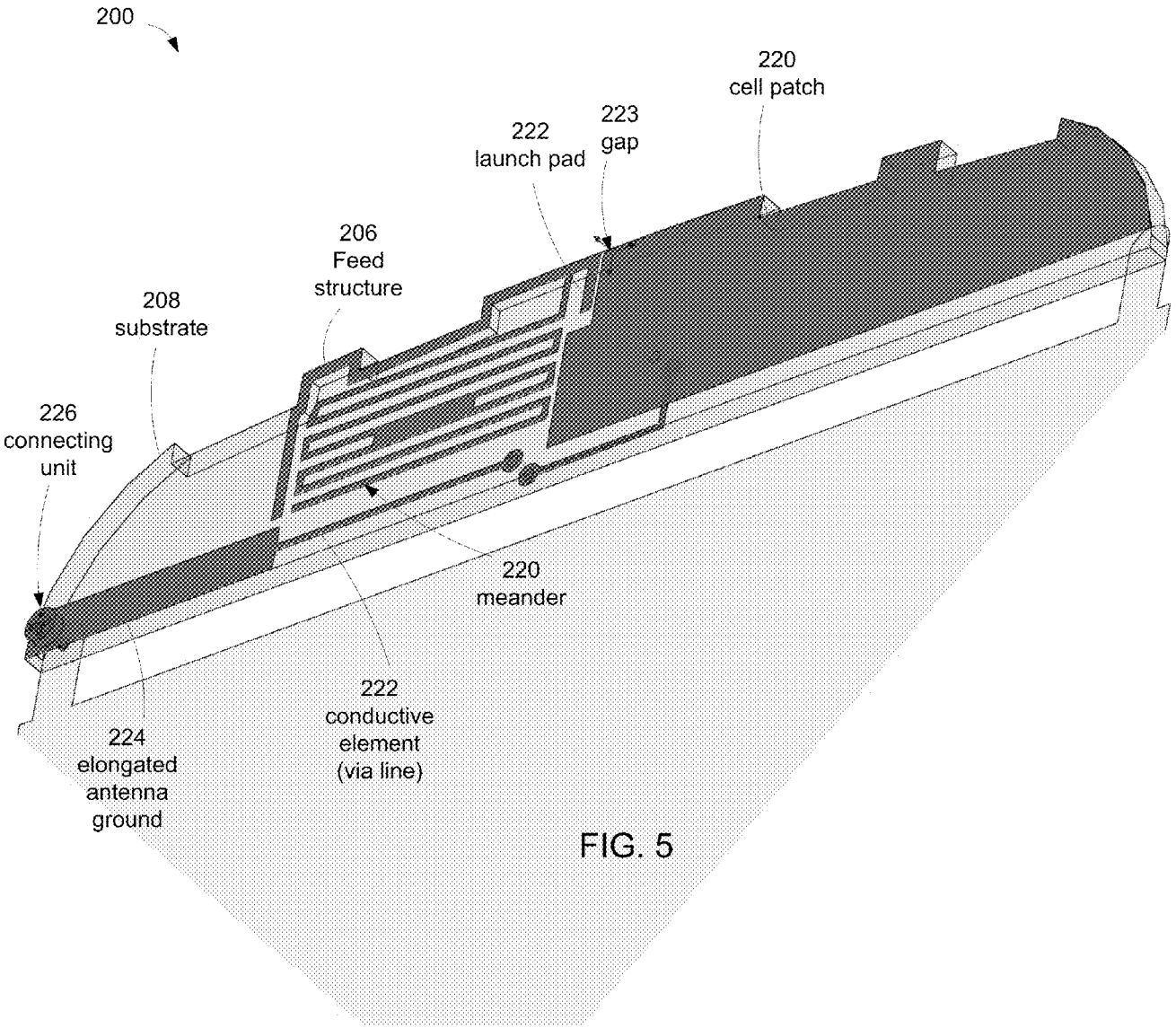
FIG. 5 illustrates an example including a cell patch positioned in available space on a portion of a substrate.

FIG. 5 illustrates the device 200 including the cell patch 220 positioned in available space on a portion of substrate 208. The various CRLH structures are conductive materials in a metallic layer on the substrate 208. The cell patch 220 is further capacitively coupled to the feed structure 206 through gap 223. The feed structure 206 has a meander 220 to enhance performance. The structure and shape of the meander 220 is determined by the shape and complexity of the device design as well as the specification frequency ranges. A variety of shapes may be used to build the meander. As illustrated in FIG. 5, this embodiment incorporates an elongated antenna ground 224, and an extended portion of the main ground may be formed near the board edge close to the cell phone enclosure. Thus, the mechanical and electrical connection via the screw between the antenna ground and the main ground is accommodated near the board edge in this example. The present configuration allows for an extra space surrounded by the feed line, antenna ground and board edge. The extra space may be utilized, for example, to add a second cell patch of the antenna for optimization or for a different application, to install a component such as a microphone, a connector, an LED, etc., or to simply enlarge the original antenna for better efficiency.

Figure 6B:
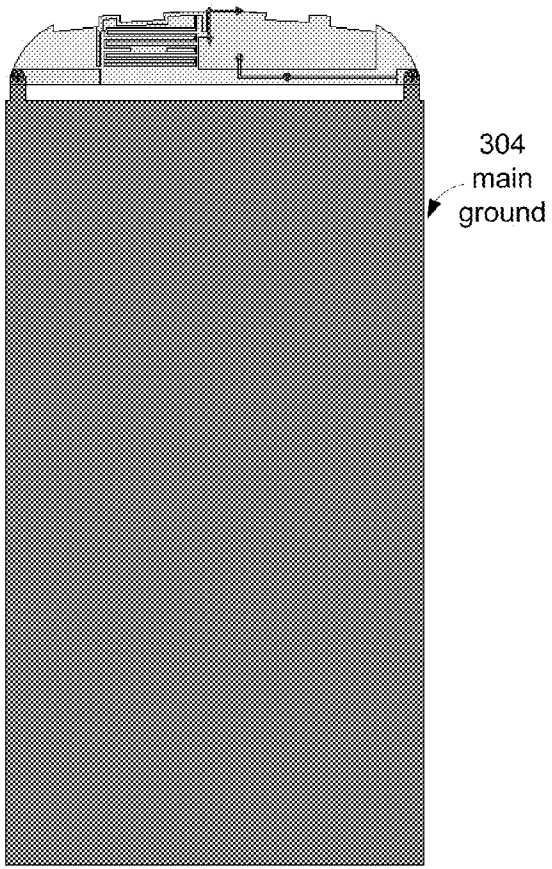
FIGS. 6A and 6B illustrate top views of an example incorporating multiple connecting units.
Figure 6A:
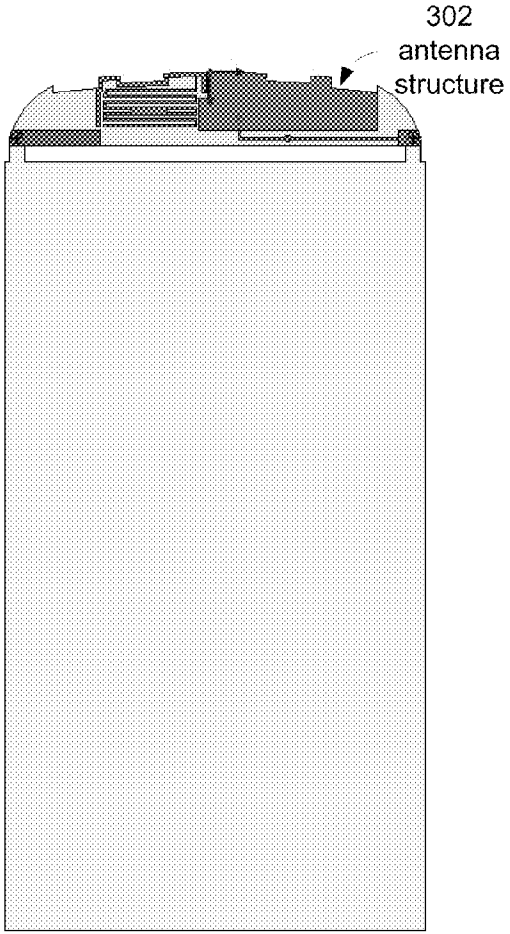

FIGS. 6A and 6B illustrate top views of another embodiment incorporating multiple connecting units. The device 300 is illustrated in top view, identifying the placement of the antenna structure 302 and the main ground 304, The CRLH structures used for the antenna structure 302, and the other antenna structures described herein, place the ground electrodes at a distance from the antenna structures so as to reduce a capacitance formed therebetween.

Figure 7:
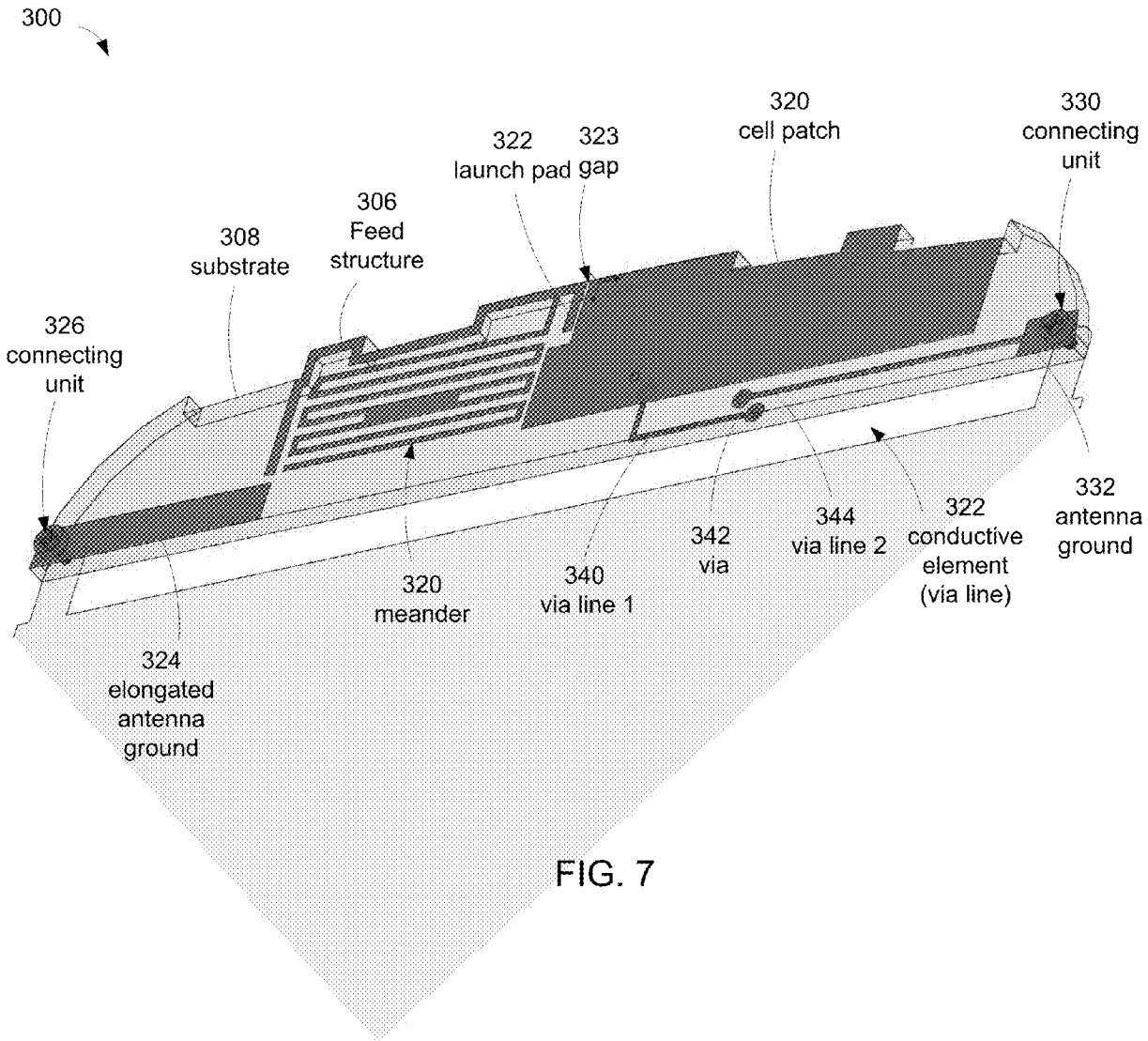
FIG. 7 illustrates an example of two screws with an antenna structure.

FIG. 7 illustrates an implementation example of two screws with an antenna structure 302 in a device 300. The antenna elements are formed with a similar design as in the previous antenna examples based on a CRLH structure, except the device 300 incorporates multiple antenna grounds.

As illustrated in FIG. 7, the cell patch 320 is capacitively coupled to the feed structure 306 through gap 323. The feed structure 306 includes a launch pad 322, which may be designed to adjust the capacitance between the feed structure 306 and the cell patch 320. A meander 320 is coupled to the feed structure 306, or may be part of the feed structure 306 and enhances performance of the antenna structure and device 300. An elongated antenna ground 324 is formed in the position similar to that of the previous examples, and is coupled to a connecting unit 326. A second antenna ground 332 is coupled to conductive element 322 that is further coupled to cell patch 320, Note that the elongated antenna ground 324 does not connect with the conductive element 322. The conductive element 322 has multiple traces, or via lines, and is formed by via line 340, via 342 and via line 344, formed in a direction away from the elongated antenna ground 324. In this way, the conductive element 322 is coupled to antenna ground 332. The elongated antenna ground 324 and antenna ground 332 are formed near the board edges opposite to each other. Connecting units 332 and 326 coupled the antenna ground 332 and the elongated antenna ground 324 to extended portions of the main ground near different board edges. Such configuration avoids possible electromagnetic interferences between the meander 320 and the conductive element 322, which could occur when traces extend close to each other, for example, under space constrained design.

Figure 8:
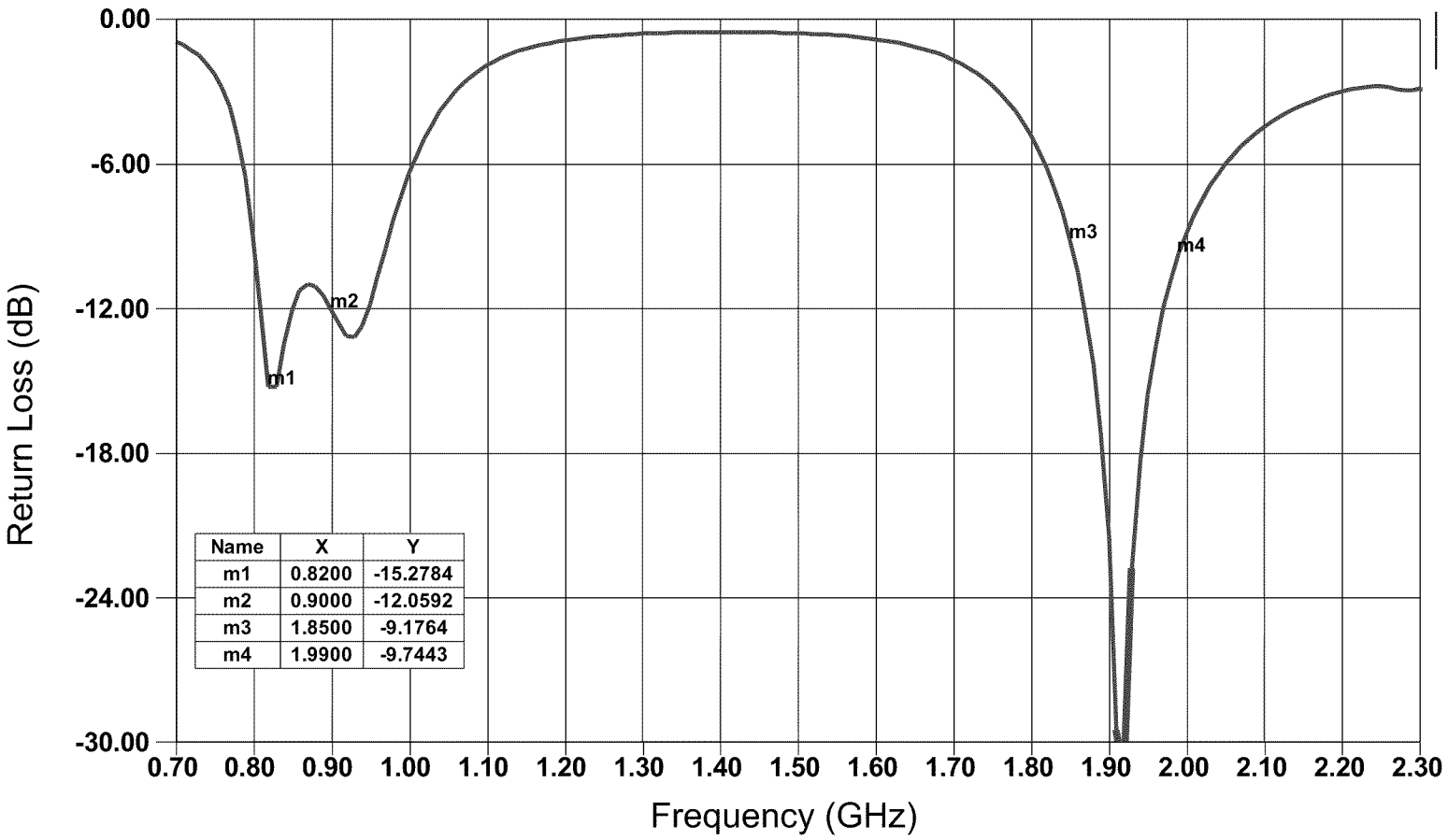
FIG. 8 illustrates a return loss versus frequency for an implementation of a device as in the examples of FIG. 1A, 1B, 2A, 2B, 2C, or 3.

FIG. 8 plots return loss versus frequency for a first implementation of a device as in examples of FIGS. 1-3. The antenna in this example is tuned and matched to three cellular phone bands, i.e., the 850 MHz band, the 900 MHz band and the PCS band. The design of the antenna may be adjusted depending on applications. The graph is a plot of return loss as a function of frequency. As illustrated, a first resonant frequency is identified at the far right, which is the RH resonant frequency. Additional LH resonant frequencies are identified on the left side of the graph. These behaviors allow a device to achieve multiple resonant frequencies with a single antenna structure.

Implementations of mechanical connection units, such as screws, for an antenna device are described in this document. Such mechanical connections are configured to provide mechanical stability as well as a short-cut connection between grounds. The antenna examples illustrated herein are MTM antennas that are designed based on CRLH structures. Shapes and dimensions of antenna elements may be varied depending on target applications. Various MTM antennas are described in the aforementioned patent applications, Note that the present implementation examples of mechanical connection units can be extended to a wide variety of antennas, including conventional printed antennas. An antenna port may be located in the main ground, and a connector may be used to couple the feed line to the antenna port in the examples in this document. However, a screw or other conductive mechanical connection unit may be used to couple the feed line to the antenna port to provide a short-cut connection instead of a connector and associated routing.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination. Only a few implementations are disclosed. However, it is understood that variations and enhancements may be made.

What is claimed is what is described and illustrated, including:

1. An antenna device comprising:

a substrate structure comprising one or more metallization layers structured to include:

a first ground electrode which is formed in one of the one or more metallization layers;

and a plurality of electrically conductive parts formed in at least one of the one or more metallization layers for transmitting and receiving an antenna signal, the plurality of conductive parts including:

a cell patch;

a feed structure coupled to the cell patch using a capacitive coupling; and one or more connecting units, each mechanically engaging parts of the substrate structure and electrically coupling the first ground electrode to a second ground electrode comprising an assembly separate from the substrate comprising the one or more metallization layers;

wherein the plurality of electrically conductive parts and at least part of the substrate structure are configured to form a composite left and right handed (CRLH) antenna structure that exhibits a plurality of frequency resonances associated with the antenna signal.

2. The antenna device as in claim 1 the antenna device further comprising:

a conductive element coupling the cell patch to the first ground electrode, wherein the conductive element forms an inductive loading to the cell patch, and wherein at least one connecting unit is coupled to the conductive element.

3. The antenna device as in claim 2, wherein the feed structure comprises a launch pad proximate the cell patch.

4. The antenna device as in claim 2, wherein the capacitive coupling between the feed structure and the cell patch forms a Left Hand (LH) capacitance.

5. The antenna device as in claim 4, wherein the inductive loading forms a LH inductance.

6. The antenna device as in claim 5, wherein the antenna device is structured to support a first resonant frequency and the LH capacitance and inductance are each structured to support a second resonant frequency.

7. The antenna device as in claim 6, wherein the first resonant frequency is a higher frequency than the second resonant frequency.

8. The antenna device as in claim 1, wherein the connecting unit is a screw made of a conductive material.

9. The antenna device as in claim 1, wherein the connecting unit is to couple to a wireless device housing.

10. The antenna device as in claim 1, wherein the cell patch is located on a first metallization layer, and wherein the first ground electrode is located on the first metallization layer.

11. A wireless device, comprising:

a ground electrode;

an antenna element configured to provide a Composite Right Left Hand (CRLH) based structure, the antenna element including:

a substrate comprising one or more metallization layers including:

a cell patch; and a feed structure capacitively coupled to the cell patch; and a connection element providing mechanical connection of portions of the wireless device, the connection element coupling the antenna element to the ground electrode, wherein the ground electrode is separate from the substrate comprising the one or more metallization layers; and wherein the antenna element is configured to provide a plurality of specified resonances using the CRLH based structure.

12. The wireless device as in claim 11, wherein the antenna element comprises an inductive load coupled between the cell patch and the ground electrode, wherein the connection element couples the inductive load to the ground electrode.

13. The wireless device as in claim 12, wherein the one or more metallization layers include an antenna ground coupled to the inductive load.

14. The wireless device as in claim 13, comprising a second connection element providing mechanical connection of the portions of the wireless device, the second connection element coupling the antenna element to the ground electrode.

15. The wireless device as in claim 11, comprising an antenna ground included as a portion of the one or more metallization layers, wherein the cell patch is located on a first metallization layer, and wherein the antenna ground is located on the first metallization layer.

16. A method for forming a wireless device, comprising forming an antenna element on a substrate, the antenna element configured to provide a Composite Right Left Hand (CRLH) based structure, including:

forming one or more metallization layers included as a portion of a substrate, the one or more metallization layers including:

a cell patch; and a feed structure capacitively coupled to the cell patch; and forming a connection element providing mechanical connection of portions of the wireless device, the connection element coupling the antenna element to a ground electrode, wherein the ground electrode is separate from the substrate comprising the one or more metallization layers, and wherein the antenna element is configured to provide a plurality of specified resonances using the CRLH based structure.

17. The method as in claim 16, further comprising:

forming an inductive load coupled between the cell patch and the ground electrode, wherein the connection element couples the inductive load to the ground electrode.

18. The method as in claim 17, wherein the substrate is made of a dielectric material.

19. The method as in claim 16, wherein the connection element is a screw.

20. The method as in claim 16, wherein the connection element is a C-clip.

* * * * *